US009717137B2

(12) United States Patent
Hansen et al.

(10) Patent No.: US 9,717,137 B2
(45) Date of Patent: Jul. 25, 2017

(54) X-RAY HOUSING HAVING INTEGRATED OIL-TO-AIR HEAT EXCHANGER

(71) Applicant: Varian Medical Systems, Inc., Palo Alto, CA (US)

(72) Inventors: Wayne R. Hansen, Centerville, UT (US); Travis Astle, Salt Lake City, UT (US); Patrick Kevin Lewis, West Jordan, UT (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 707 days.

(21) Appl. No.: 14/176,926

(22) Filed: Feb. 10, 2014

(65) Prior Publication Data

US 2015/0139406 A1 May 21, 2015

Related U.S. Application Data

(60) Provisional application No. 61/906,248, filed on Nov. 19, 2013.

(51) Int. Cl.
*H05G 1/02* (2006.01)

(52) U.S. Cl.
CPC ..... *H05G 1/025* (2013.01)

(58) Field of Classification Search
CPC ..... H05G 1/025
See application file for complete search history.

(56) References Cited

U.S. PATENT DOCUMENTS

| | | | | |
|---|---|---|---|---|
| 4,355,410 A * | 10/1982 | Sullins | H05G 1/025 378/199 |
| 6,400,799 B1 | 6/2002 | Andrews | |
| 2007/0000648 A1 | 1/2007 | Crocker et al. | |
| 2007/0240849 A1 | 10/2007 | Lin et al. | |
| 2009/0225951 A1 | 9/2009 | Wandke et al. | |

FOREIGN PATENT DOCUMENTS

| | | |
|---|---|---|
| DE | JP361104547 A * | 4/1998 |
| JP | 059128198 U * | 8/1984 |
| JP | 200726800 A | 2/2007 |

OTHER PUBLICATIONS

PTO 16-109722 Eglish translation of JP059128198U.*
International Search Report and Written Opinion mailed Feb. 13, 2015 in related PCT Application No. PCT/US2014/066381 (12 pgs).

* cited by examiner

*Primary Examiner* — David J Makiya
*Assistant Examiner* — John Corbett
(74) *Attorney, Agent, or Firm* — Maschoff Brennan

(57) ABSTRACT

An x-ray housing can include a tubular unitary body having an external fin array adjacent to an internal fin array through a heat exchanger portion of the unitary body, the internal fin array being on a luminal surface of a housing lumen of the unitary body. The external fin array can extend from a first end of the housing to a second end of the housing. The external fin array may be at a discrete and defined location, and extend around only a portion (e.g., 25%) of a circumference or external surface of the housing. The internal fin array can extends from the first end of the housing to an arced manifold recess at the second end of the housing, and be located in a finned recess that is adjacent to and dimensioned correspondingly with the external fin array.

21 Claims, 14 Drawing Sheets

X-RAY HOUSING HAVING INTEGRATED OIL-TO-AIR HEAT EXCHANGER

CROSS-REFERENCE TO RELATED APPLICATIONS

The present application claims the benefit of U.S. Provisional Application No. 61/906,248 filed Nov. 19, 2013, which provisional application is incorporated herein by specific reference in its entirety.

BACKGROUND

X-ray devices are extremely valuable tools that are used in a wide variety of applications such as industrial and medical. For example, such equipment is commonly employed in areas such as medical diagnostic examination, therapeutic radiology, semiconductor fabrication, and materials analysis.

Regardless of the applications in which they are employed, most x-ray devices operate in a similar fashion. X-rays are produced in such devices when electrons are emitted, accelerated, and then impinged upon a material of a particular composition. This process typically takes place within an x-ray tube located in the x-ray device.

The subject matter claimed herein is not limited to embodiments that solve any disadvantages or that operate only in environments such as those described above. Rather, this background is only provided to illustrate one exemplary technology area where some embodiments described herein may be practiced.

SUMMARY

In one embodiment, an x-ray housing can include a tubular unitary body having an elongate external fin array adjacent to an elongate internal fluid passageway recess formed into a lumen wall through a heat exchanger portion of the unitary body. The external fin array and internal fluid passageway recess can circumferentially extend partially around the tubular unitary body such that corresponding side edges of the external fin array and the internal fluid passageway recess are radially proximal. The partial circumferential extension can be at least about 45 degrees, at least about 60 degrees, at least about 75 degrees, at least about 85 degrees, where about 86 degrees is an example. The partial circumferential extension may be the same or different for the external fin array and the internal fluid passageway recess. The difference between the external fin array and the internal fluid passageway recess can be about 1 degree, about 2 degrees, about 5 degrees, about 10 degrees, about 15 degrees, or about 20 degrees or about 25 degrees.

In one embodiment, one or more recess covers mounted to the internal fluid passageway recess so as to form an internal fluid passageway separate from the lumen. In one aspect, the one or more recess covers include edge flanges that are received into edge receptacles of the internal fluid passageway recess and mounted to edge shelves that define the edge receptacles.

In one embodiment, the internal fluid passageway recess includes an internal fin array formed by the tubular unitary body so that the internal fluid passageway is a finned fluid passageway. In one aspect, the external fin array extends from a first end of the tubular unitary body to a second end of the tubular unitary body. In one aspect, the internal fin array extends from the first end of the tubular unitary body to a manifold recess in the lumen wall at the second end of the tubular unitary body. In one aspect, the external fin array includes a plurality of longitudinal parallel fins. In one aspect, the internal fin array includes a plurality of longitudinal radial fins.

In one embodiment, a manifold is located in the manifold recess. The manifold can have at least one manifold port that fluidly couples the lumen to the finned fluid passageway. In one aspect, the one or more covers can include an elongate cover adjacent to the manifold and extending toward the first end. In one aspect, the one or more covers can include a second cover at the second end with a gap between the elongate cover and second cover so as to expose the finned fluid passageway. In one aspect, a pump can be fluidly coupled with the manifold port so as to pump fluid coolant through the finned fluid passageway. In one aspect, the pump is integrated with the manifold.

In one embodiment, a mounting bracket can be mounted in the lumen to the lumen wall between the first end and second end.

In one embodiment, the housing can include an x-ray housing window aperture across from the internal fluid passageway recess and external fin array.

In one embodiment, a fan cooling system coupled with the housing with one or more fans are oriented to cause air to flow over the external fin array.

In one embodiment, an x-ray housing can include a tubular unitary body having an external fin array adjacent to an internal fin array formed into a lumen wall through a heat exchanger portion of the unitary body. The external fin array and internal fin array can circumferentially extend partially around the tubular unitary body such that corresponding side edges of the external fin array and the internal fin array are radially proximal. In one aspect, one or more covers can be mounted in the lumen to the tubular unitary body over the internal fin array so as to form a finned fluid passageway separate from the lumen. In one aspect, the external fin array can extend from a first end of the tubular unitary body to a second end of the tubular unitary body. In one aspect, the internal fin array can extend from the first end of the tubular unitary body to a manifold recess in the lumen wall at the second end of the tubular unitary body. In one aspect, a manifold can be in the manifold recess, where the manifold can have at least one manifold port that fluidly couples the lumen to the finned fluid passageway. In one aspect, a pump can be fluidly coupled with the manifold port so as to pump fluid coolant through the finned fluid passageway.

In one embodiment, a method of cooling an x-ray device can include: providing an x-ray housing having an x-ray tube in the lumen with fluid coolant between portions of the x-ray tube and lumen wall of the x-ray housing; and passing the fluid coolant from the lumen through the internal fluid passageway recess such that heat is transferred from the fluid coolant into the heat exchanger portion of the unitary body; and blowing air across the external fin array such that heat is transferred from the heat exchanger portion of the unitary body into the blown air by the external fin array.

In one embodiment, a method of cooling an x-ray device can include: providing the x-ray housing having an x-ray tube in the lumen with fluid coolant between portions of the x-ray tube and lumen wall of the x-ray housing; and passing the fluid coolant from the lumen through the internal fin array such that heat is transferred from the fluid coolant into the heat exchanger portion of the unitary body; and blowing air across the external fin array such that heat is transferred from the heat exchanger portion of the unitary body into the blown air by the external fin array.

BRIEF DESCRIPTION OF THE FIGURES

The foregoing and following information as well as other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1:
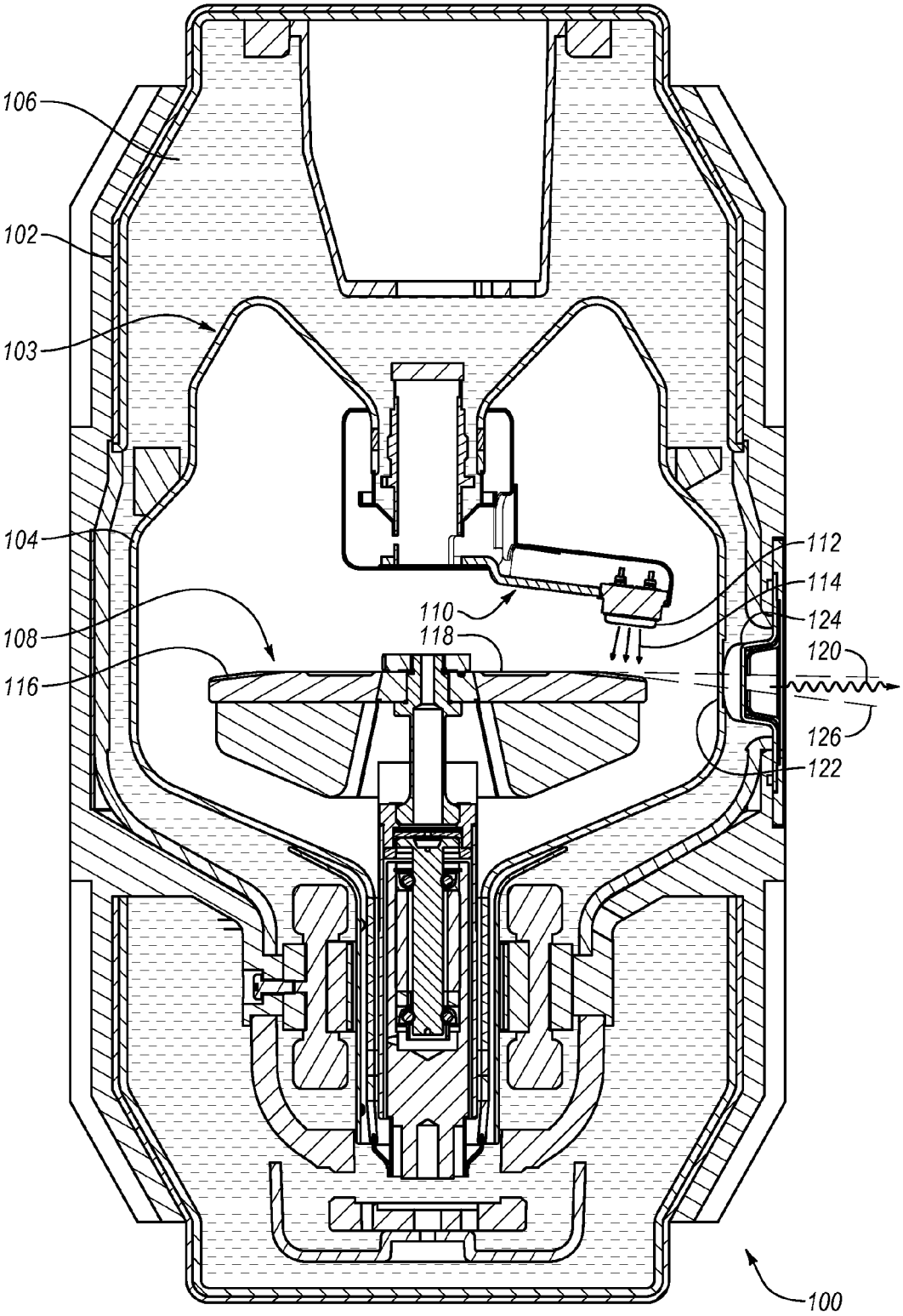
FIG. 1 illustrates an embodiment of an x-ray device.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Briefly summarized, embodiments presented herein are directed to an x-ray housing of an x-ray device, where the x-ray housing retains an x-ray tube therein. The x-ray tube is positioned within an internal chamber of the x-ray housing that is configured to hold a volume of fluid coolant around the x-ray tube. The x-ray housing is configured with external fins and internal fins to facilitate improved heat transfer of the fluid coolant and the x-ray tube. The x-ray tube includes a vacuum enclosure that contains an anode and cathode. The anode is positioned to receive electrons produced by the cathode within the x-ray tube so that x-rays are generated at the anode and directed out of the vacuum enclosure through an x-ray tube window and out of the x-ray tube. The x-ray housing includes an x-ray housing window positioned relative to and aligned with the x-ray tube window and that is transmissive to the x-rays. The x-ray device also includes a detector array configured to detect x-rays produced by the anode.

The fluid coolant contained in the internal chamber of the x-ray housing can encompass any one of a variety of substances that can be employed in cooling and/or electrically isolating an x-ray device or similar device. Examples of fluid coolants include, but are not limited to, de-ionized water, insulating liquids, and dielectric oils. Often, fluid coolant is used within the x-ray housing internal chamber and circulated around the x-ray tube in order to pull heat from the x-ray tube. The circulation can be passive by temperature-driven fluid flow or active by a fluid pump. The heated fluid coolant can be contained and/or passed through fin recesses in the housing that are thermally associated with internal fins of a heat exchanger region that includes external fins associated with the internal fins in order to cool the heat exchanger region of the housing and fluid coolant. Also, the heated fluid coolant can be passed through passageways, such as finned passageways, in the housing that are thermally associated with external fins to cool the region of the housing and cooling fluid passing therethrough. The cooled fluid coolant is then circulated around the x-ray tube again, which allows for the fluid coolant to be cycled within the x-ray housing.

FIG. 1 is a simplified cross-section depiction of an example x-ray device 100, where the shape, arrangement, and orientation of the features and components may be altered and modified to suit particular operating environments. The x-ray device 100 includes an outer housing 102, within which is positioned an x-ray tube 103 having a vacuum enclosure 104. A fluid coolant 106 is also positioned within the outer housing 102 and circulates around the x-ray tube 103 having the vacuum enclosure 104 to assist in cooling the x-ray tube 103 and to provide electrical isolation between the x-ray tube 103 and the outer housing 102. In one embodiment, the fluid coolant 106 comprises dielectric oil, which exhibits acceptable thermal and electrical insulating properties.

Positioned within the vacuum enclosure 104 are a rotating anode 108 and a cathode 110. The anode 108 is spaced apart from and oppositely positioned to the cathode 110, and is at least partially composed of a thermally conductive material. In some embodiments, the anode 108 is at least partially composed of tungsten or a molybdenum alloy. The anode 108 and the cathode 110 are connected within an electrical circuit that allows for the application of a high voltage potential between the anode 108 and the cathode 110. The cathode 110 includes a filament 112 that is connected to an appropriate power source, and during operation, an electrical current is passed through the filament 112 to cause electrons, designated at 114, to be emitted from the cathode 110 by thermionic emission. The application of a high voltage differential between the anode 108 and the cathode 110 causes the electrons 114 to accelerate from the filament 112 toward a focal track 116 positioned on a target surface 118 of the anode 108. The focal track 116 is typically composed of tungsten or a similar material having a high atomic ("high Z") number. As the electrons 114 accelerate, they gain a substantial amount of kinetic energy, and upon striking the target material on the focal track 116, some of this kinetic energy is converted into electromagnetic waves of very high frequency, which are x-rays 120.

The focal track 116 and the target surface 118 are oriented so that the emitted x-rays 120 are directed toward an x-ray tube window 122. The x-ray tube window 122 is comprised of an x-ray transmissive material and is positioned along a wall of the vacuum enclosure 104 at a location that is aligned with the focal track 116 and to allow the x-rays 120 to pass out of the x-ray tube 103. An x-ray housing window 124 is positioned in the outer housing 102 and is spaced apart from and oppositely positioned to the x-ray tube window 122.

The x-ray housing window 124 is attached in a fluid-tight arrangement to the outer housing 102 so as to enable the x-rays 120 to pass from the x-ray tube window 122, through the x-ray housing window 124, and exit the outer housing 102. The x-rays 120 that emanate from the vacuum enclosure 104 and pass through the x-ray housing window 124 may do so substantially as a diverging beam. The path of the diverging beam that is generally used to create images is generally indicated at 126.

Generally, the features of the outer housing 102 having the external fins and internal fins to facilitate improved cooling of the fluid coolant 106 and the x-ray tube 103 are described in more detail herein. Also, the fluid coolant 106 can be circulated by an integrated coolant circulation system, as described in more detail herein.

Figure 2A:
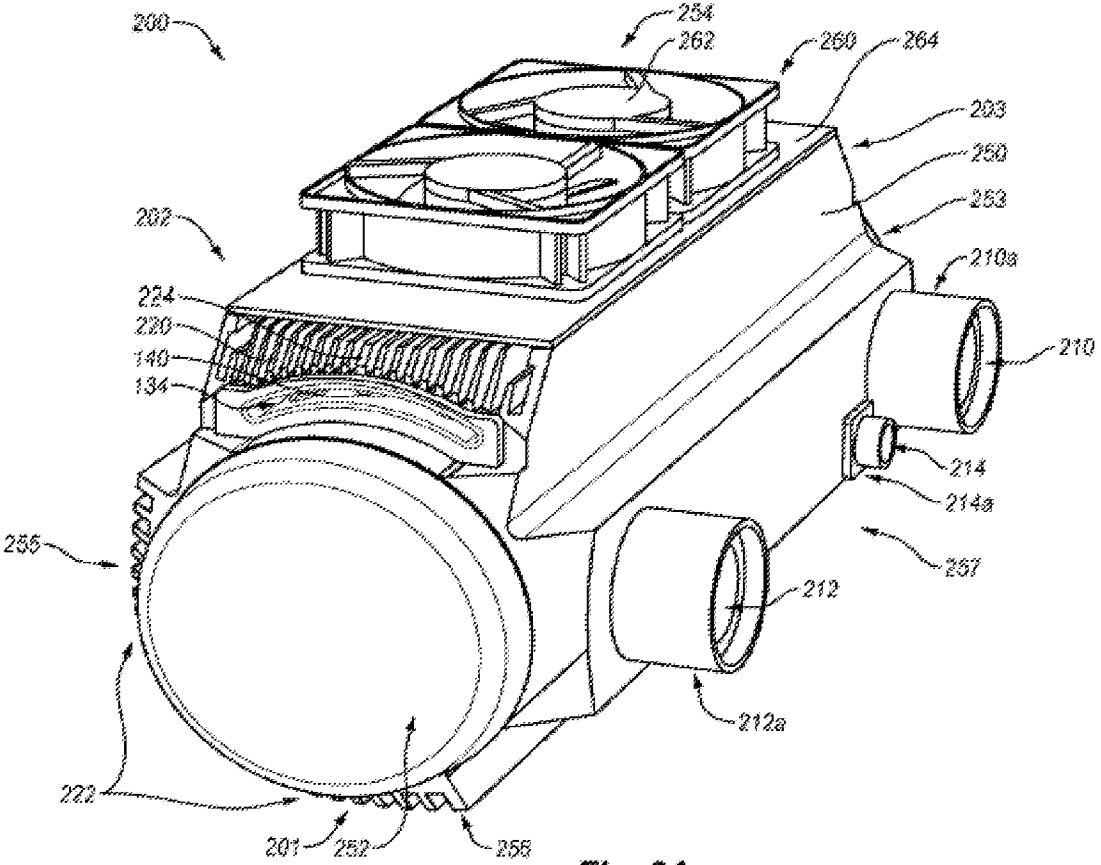
FIGS. 2A-2B illustrate different views of an x-ray device having an internal fluid passageway and external fins.
Figure 2B:
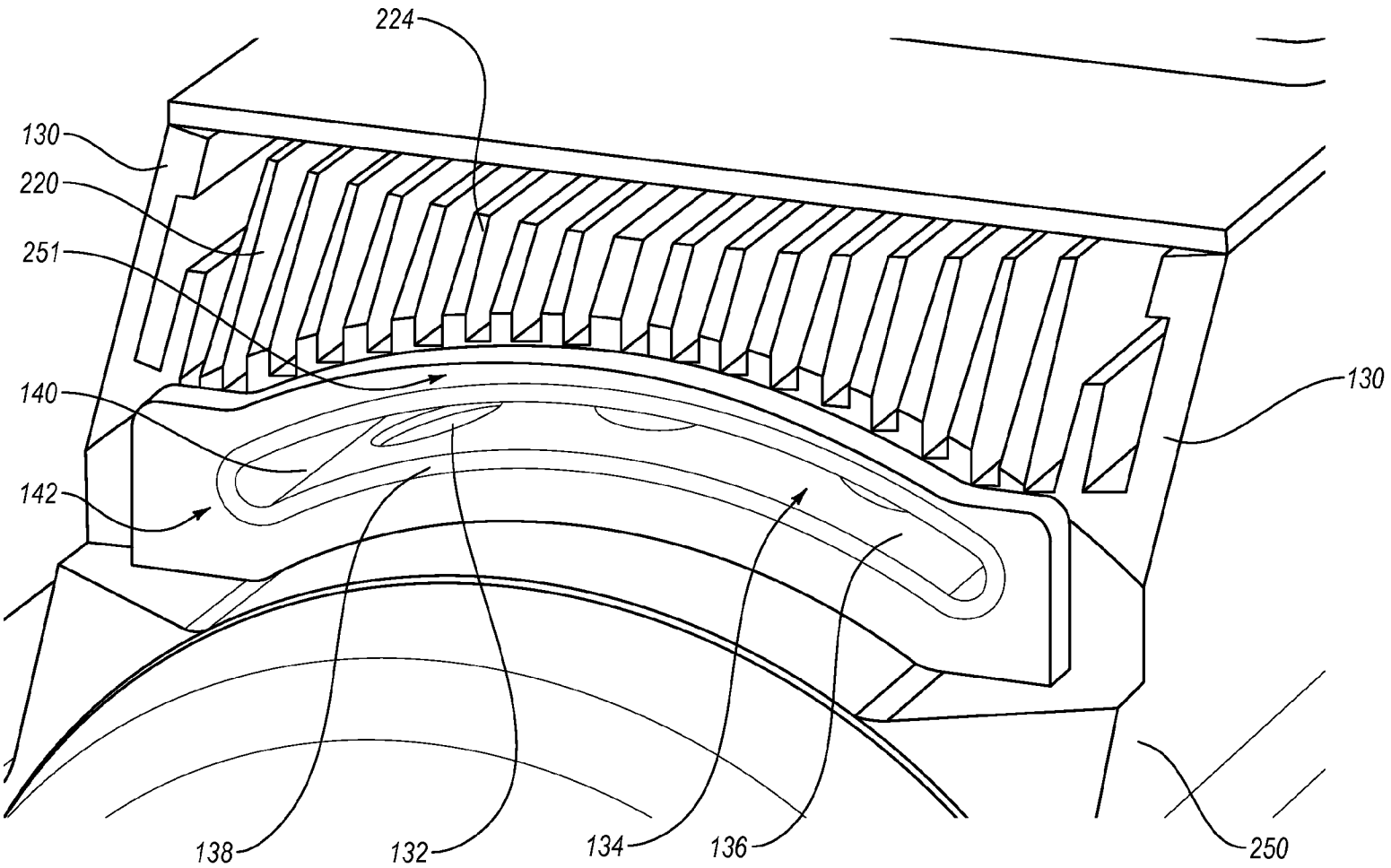

FIGS. 2A-2B show an embodiment of an x-ray device 200 that includes a housing 202 with an external fin array 220 and an internal fluid passageway 140 that are located adjacent to each other at a heat exchanger region to improve thermal coupling of the fluid coolant and air. In one embodiment, the internal fluid passageway 140 can include an internal fin array 230 that is shown in subsequent figures. When the internal fluid passageway 140 includes the internal fin array 230, the internal fluid passageway can be referred to as a finned fluid passageway 240, where the internal fin array 230 is shown more clearly and in more detail in subsequent figures. A body 250 of the housing defines the external fin array 220 and the internal fluid passageway 140. The body 250 can include a one-piece structure that provides the housing 202 and structures defined therein.

Figure 3A:
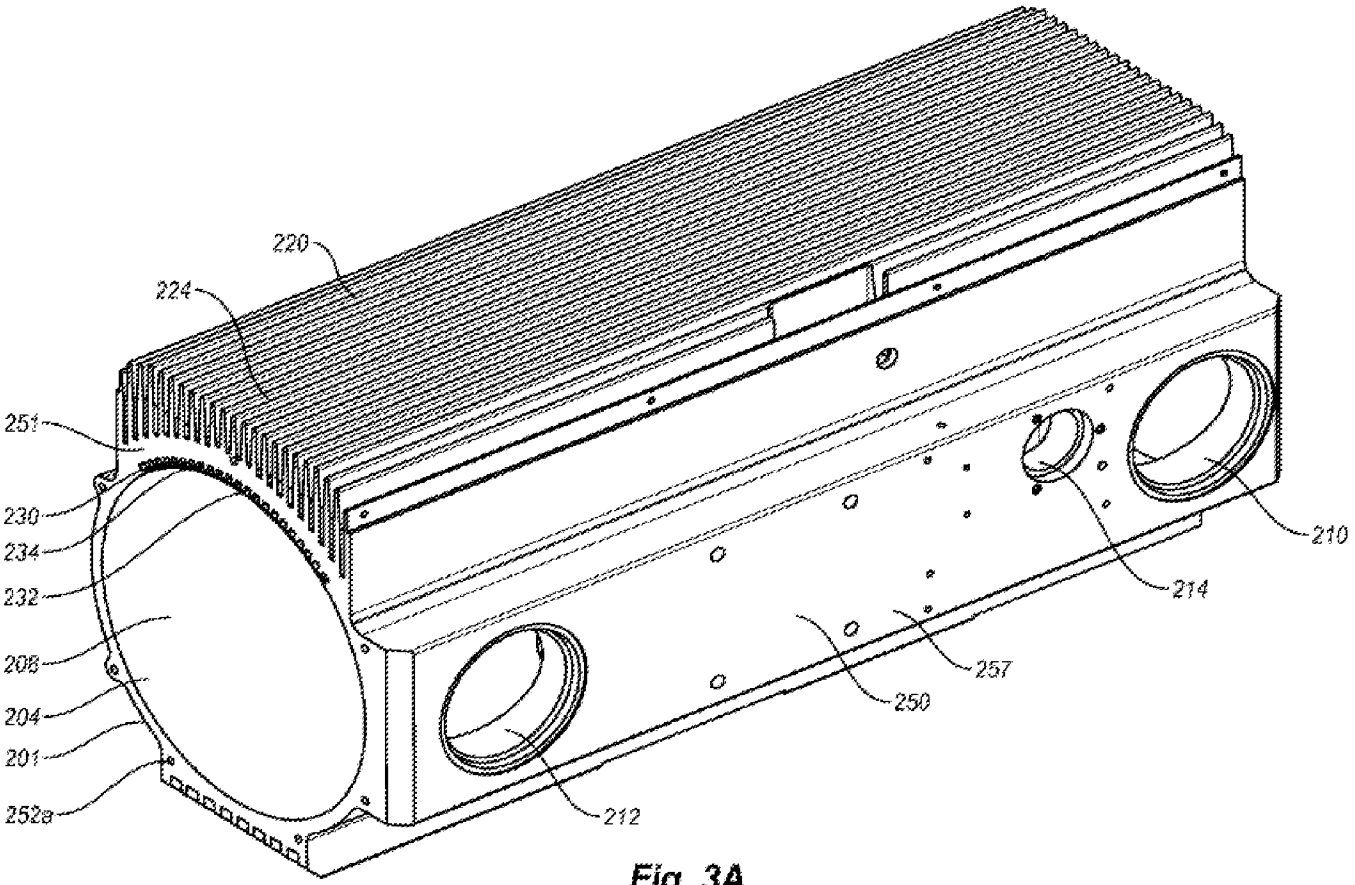
FIGS. 3A-3B illustrate different views of an embodiment of an x-ray housing having internal fins and external fins.
Figure 3B:
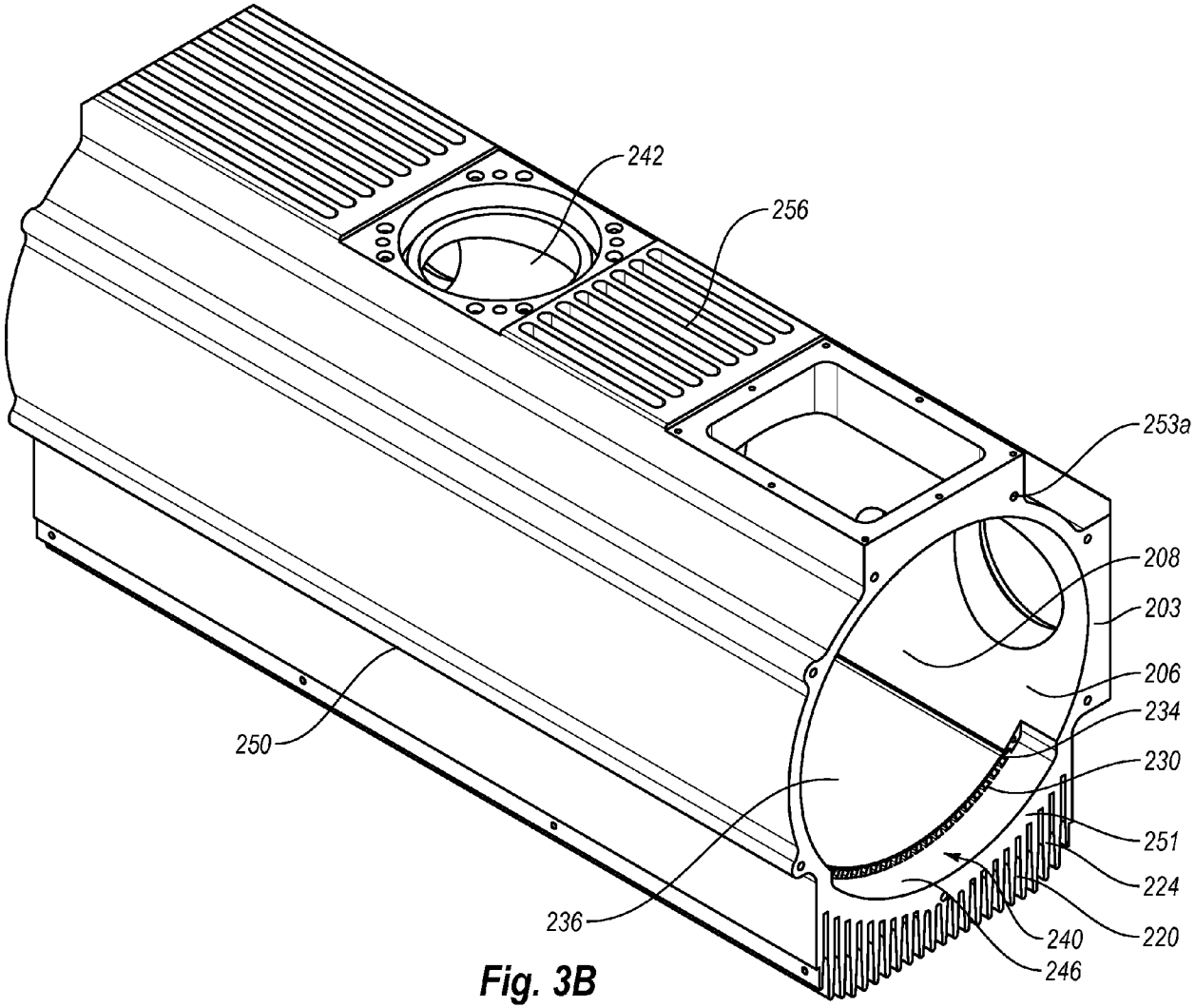

The internal fluid passageway 140 can include fins or be devoid of fins. While none are shown in FIGS. 2A-2B, the internal fluid passageway 140 can have fins on the body 250 or a passage cover 136 that separates the internal fluid passageway 140 from a lumen 208 (FIGS. 3A-3B). In one aspect, the internal fluid passageway 140 can be defined by an insert 138 that fits into a recess 134 in the body 250 of the housing 202. The insert 138 can be tubular to form the internal fluid passageway 140 as shown, and it can fit into the recess 134. The passage cover 136 can be a part of the insert 138 when the insert is included. However, the passage cover 136 can couple to the body 250 in the lumen 208 in order to form the internal fluid passageway 140 to be defined by the recess 134 and passage cover 136. The passage cover 136 and/or the insert 138 can include apertures 132 that facilitate fluid coolant to flow from the lumen 208 into the internal fluid passageway 140. When the insert 138 is used to define the internal fluid passageway 140, it can be utilized substantially as described with the covers and fit into the recess in the housing as per FIGS. 10A-10D. The insert 138 may be considered to be a cover as it separates and covers the internal fluid passageway 140 from the lumen 208.

The internal fluid passageway 140 can have various dimensions and shapes. However, in one aspect the internal fluid passageway 140 is arc shaped or "C" shaped as shown in FIGS. 2A-2B. The internal fluid passageway 140 can be dimensioned to span from one side of the external fin array 220 to the other side of the external fin array 220. The internal fluid passageway 140 can have an elongate cross-sectional profile that bends or wraps around the lumen 208 shape. The internal fluid passageway 140 is shown to have a dimension that is close to about one side of the housing 202 or about ¼ of the circumference of the housing 202 or lumen 208. In one aspect, the internal fluid passageway can extend around the housing 202 or lumen 208 about 10% to about 33%, or about 12% to about 30%, or about 15% to about 25%, or about 20%. The internal fluid passageway 140 and the external fin array 220 can be separated by a heat exchanger region 251 of the body 250. That is, the portion of the body 250 separating the external fin array 220 from the internal fluid passageway 140 can be considered to be the heat exchanger region 251 because heat transfers from fluid coolant in the internal fluid passageway 140 through the heat exchanger region 251 to the external fin array 220 and then to the air. The properties of the internal fluid passageway 140 can be applied to the finned fluid passageway 240 described herein.

The body 250 of the housing 202 can be coupled to an air circulating system 260 that is adjacent to the external fin array 220. The air circulating system 260 can include one or more fans 262, where two fans 262 are shown. The fans 262 are mounted in a fan plate 264, which may also be configured as a shroud. As such, the air circulating system 260 is positioned over the external fin array 220 so that the fan plate 264 positions the fans 262 to circulate air through the external fin array 220, which can be by blowing into the external fin array 220 or sucking air therefrom. The fan plate 264 is shown to be positioned above the external fin array 220 so that they do no touch and a gap exists therebetween; however, the external fin array 220 can have one or more external fins 224 that contact the fan plate 264. In one aspect, outer external fins 224 can be coupled to the fan plate 264 via fasteners. On one aspect, risers 130 can be positioned on both sides of the external fin array 220, and the risers 130 can be coupled to the fan plate 264. However, the risers 130 may be the external fins 224 that are dimensioned to couple with the fan plate 264.

In one embodiment, secondary external fin arrays 222 can be included on other surfaces of the body 250 of the housing 202, which are not shown to have air circulating systems; however, one or more of the secondary external fin arrays 222 may be associated with air circulating systems that include fans. The secondary external fin arrays 222 can have variously shaped and dimensioned fins, which may or may not be the same as the external fins 224 of the external fin array 220.

The housing 202 can include a cathode end 201 that can be coupled to a cathode cap 252, where the cathode end 201 houses the cathode. The housing 202 can include an anode end 203 that can be coupled to an anode cap 253, where the anode end houses the anode and/or anode operational components. The cathode cap 252 and the anode cap 253 can be coupled to the body 250 by any suitable means, which can be removable (e.g., with fasteners, such as bolts) or fixedly coupled (e.g., welded, brazed, etc.).

As shown, the body 250 of the housing includes three finned sides 254, 255, 256, and one ported side 257. While the finned side 254 with the external fin array 220 and the air circulating system 260 are adjacent to the ported side 257, any configuration and arrangement may be utilized.

The body 250 of the housing 202 also includes first and second electrical ports 210, 212 that can be used for providing electrical conduits for powering the anode and cathode to operate the x-ray device 200. In one configuration, the first electrical port 210 can be the anode electrical port, and the second electrical port 212 can be the cathode electrical port, or alternatively vice versa. A third electrical port 214 can be included in the body 250 of the housing 202, which can be used for powering an integrated coolant circulation system that includes a coolant pump. The first, second, and third ports 210, 212, 214 can be apertures or holes through the body 250. The first electrical port 210 is shown to include a first electrical port receptacle 210*a*, the second electrical port 212 is shown to include a second electrical port receptacle 212*a*, and the third electrical port 214 is shown to include a third electrical port receptacle 214*a*, which receptacles can include electrical couplers.

Generally, the housing 202 of the x-ray device 200 is an improvement with increased cooling of 1200 watts of maximum continuous heat dissipation. The x-ray device can be configured with 3- or 4-inch glass tubes in order to have high maximum continuous heat dissipation with oil circulation by an integrated pump, and controlled convection cooling. The length of the housing 202 can be about 524 mm, end to end. The height of the housing 202 can be about 258 mm from side 256 to side 254. The width of the housing can be about 232 mm from side 255 to side 257. These dimensions can vary, and are provided as examples. For example, these dimensions can range up to about 33%, 25%, 20%, 15%, 10%, 5%, 2.5%, or 1%.

In one embodiment, the internal fluid passageway 140 can be external from the lumen 208, as shown in FIG. 2B. The internal fluid passageway 140 can include end covers 142 on the ends of the passageway, where the end covers 142 can be coupled with the body 250. The end covers 142 can be coupled to the body 250 via fasteners so as to be removable or integrated by welding or brazing. The manifold described herein can be an end cover for one end.

In one embodiment, the internal fluid passageway 140 can be located between the internal finned fluid passageway 240 and the external fin array 220. As shown in FIG. 2B, the internal finned fluid passageway 240 can be under the cathode cap 252 while the internal fluid passageway 140 can be outside of the cap and between the cathode cap 252 and the external fin array 220.

FIGS. 3A-3B show different perspective views of the unitary body 250 of the housing 202; however, non-integral components that are coupled to the unitary body 250 are not illustrated. FIG. 3A shows the cathode end 201 with a cathode end opening 204, and FIG. 3B shows the anode end 203 with an anode end opening 206. That is, only the unitary body 250 and its features are shown here. Accordingly, the unitary body 250 is shown to have the external fin array 220 and the internal fin array 230 that are located adjacent to each other at the heat exchanger region 251 to improve thermal coupling of the fluid coolant and air. The heat exchanger region 251 is considered to be the portion of the body between the external fin array 220 and the internal fin array 230. The external fin array 220 includes the external fins 224 pointed outwardly and internal fin array includes internal fins 234 pointed inwardly, where the external fins 224 are separated from the internal fins 234 by the heat exchanger body region 251. As shown, the external fins 224 can be substantially parallel and point away from the finned side 254 of the body 250.

The cathode end 201 of the housing 202 can include fastening elements 252*a* that are configured to receive fasteners so that the cathode end 201 can be coupled to a cathode cap 252 to cover and seal the cathode end opening 204. The anode end 203 of the housing 202 can include fastening elements 253*a* that are configured to receive fasteners so that the anode end 203 can be coupled to the anode cap 253 to cover and seal the anode end opening 206.

Finned side 256 is shown to have a housing window aperture 242, which is opposite of the finned side 254 having the external fin array 220 and the internal fin array 230. Fastening elements can be located in the body 250 around the housing window aperture 242 to facilitate coupling a window thereto. The ported side 257 is shown to have the first, second, and third electrical ports 210, 212, 214.

As can be seen, the external fin array 220 can run from the cathode end 201 to the anode end 203. However, the internal fin array 230 can run from the cathode end 201 to an anode manifold recess 246 at the anode end 203. As such, the internal fin array 230 can end at the anode manifold recess 246, which is arced or "C" shaped on an internal wall of the body 250. The anode manifold recess 246 can extend from the internal fin array 230 to the anode end 203. Also, a cathode internal fin array cover 232 may be located at the cathode end 201 and cover the internal fin array 230 over a cathode end portion. The cathode internal fin array cover 232 is coupled to the body 250, and not integral therewith. The dimensions of the cathode internal fin array cover 232 can vary. An elongate internal fin array cover 236 may cover a region of the internal fin array 230, where a gap can be left between the cathode internal fin array cover 232 and the elongate internal fin array cover 236. The elongate internal fin array cover 236 is coupled to the body 250, and not integral therewith. The elongate internal fin array cover 236 can extend from the gap to the anode manifold recess 246. As such, coolant fluid can flow through the gap and the anode manifold recess 246 and into and through the finned fluid passageway 240 having the internal fin array 230, in either direction depending on pumping. Accordingly, the cathode internal fin array cover 232 and the elongate internal fin array cover 236 can separate the finned fluid passageway 240 from the lumen 208 of the housing 202.

Figure 4:
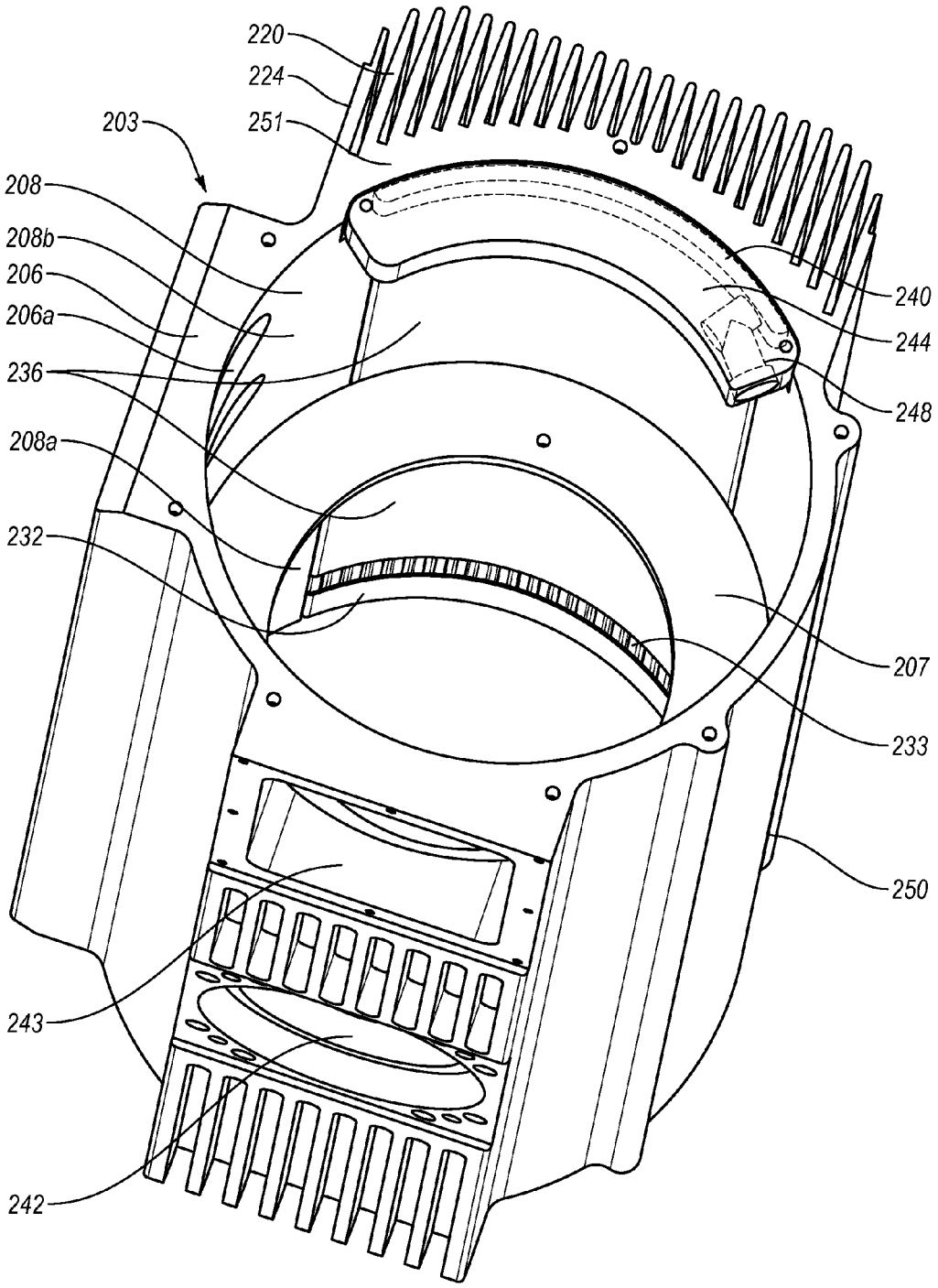
FIG. 4 illustrates a perspective end view of an embodiment of an x-ray housing having internal components associated with the internal fins.

FIG. 4 shows the anode end opening 206 with a manifold 244, an annular bracket 207, the elongate internal fin array cover 236, the cathode internal fin array cover 232, and a gap 233 between the elongate internal fin array cover 236 and the cathode internal fin array cover 232. Particularly, FIG. 4 shows the anode end 203 with the manifold 244 coupled into the anode manifold recess 246. The manifold 244 can include a manifold inlet 248 as shown in FIG. 4A in dashed lines. While the manifold inlet 248 is shown to be a passageway that enters the manifold 244 from the side, such a cooling fluid inlet or passageway can be located or oriented anywhere in the manifold 244. Also, the manifold 244 can include a plurality of the manifold inlets 248. Also, the manifold 244 can include any number of fluid passageways that fluidly couple the manifold inlet 248 with the finned fluid passageway 240.

Additionally, FIG. 4 shows that the annular bracket 207 can be included within the lumen 208 that separates the lumen 208 of the housing 202 into a cathode lumen 208*a* and an anode lumen 208*b*. The annular bracket 207 can be bonded by welding or brazing to the lumen walls of the body 250 of the housing, and may also be bonded to the elongate internal fin array cover 236. The cathode lumen 208*a* includes the cathode portion of the x-ray tube and the anode lumen 208*b* includes the anode portion of the x-ray tube. The annular bracket 207 can be used to mount the cathode portion of the x-ray tube to the housing 202 on one side, and on the other side to mount the anode portion of the x-ray tube to the housing 202. However, it should be realized that a portion of the anode may extend into the cathode lumen 208*a*, or a portion of the cathode may extend into the anode lumen 208*b*. As illustrated the housing window aperture 242 is located on the cathode lumen 208*a* side past the annular bracket 207, and thereby a portion of the anode extends into the cathode lumen 208*a*. The mechanics that rotate the anode may be located in the anode lumen 208*b*. Also, the cathode lumen 208*a* may include a secondary aperture 243, which can be used for various purposes, such as an electrical conduit for operating the motor that rotates the anode. However, the secondary aperture 243 is optional and shown as a square, but it can be any shape.

Figure 5:
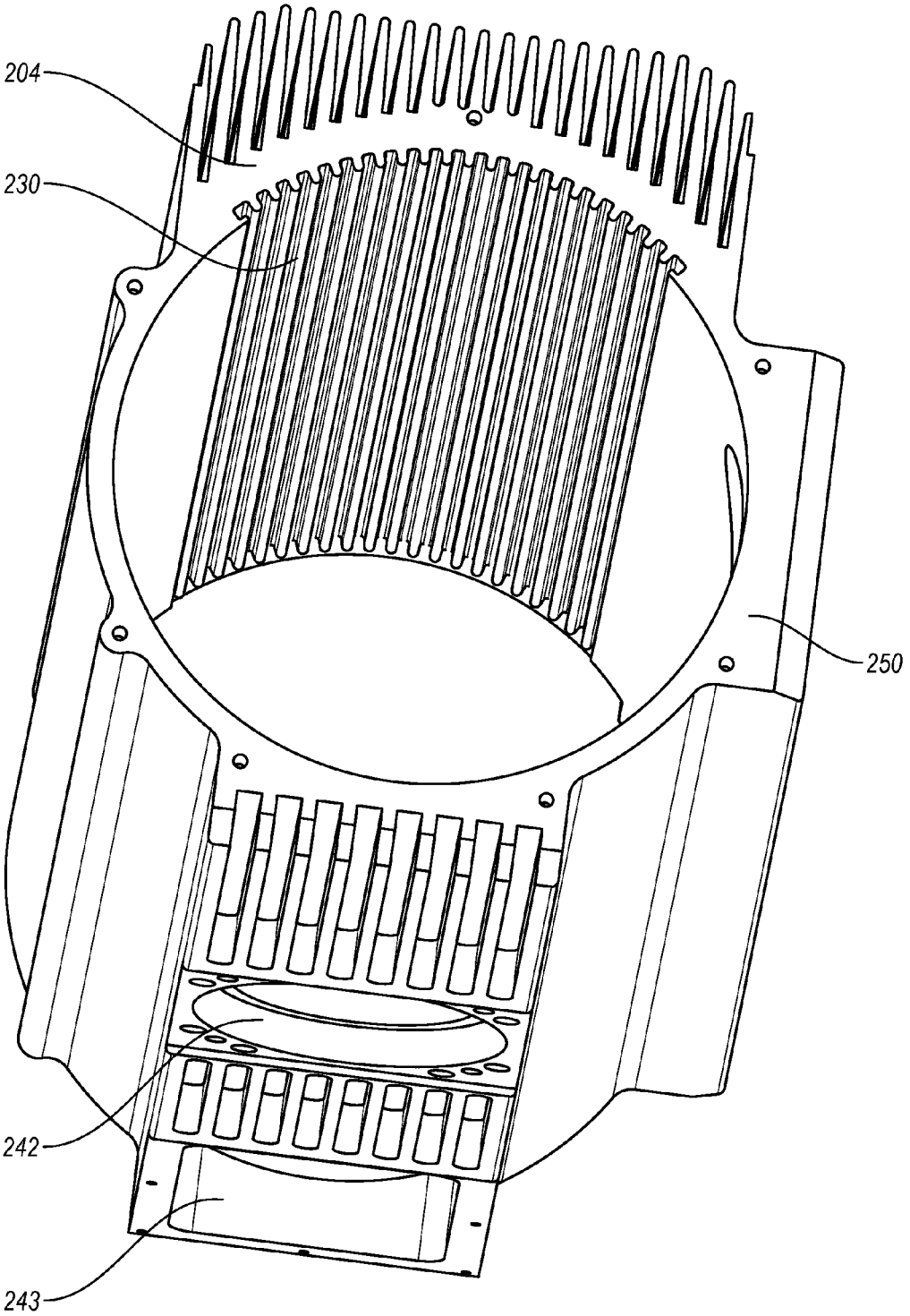
FIG. 5 illustrates a perspective end view of an embodiment of an x-ray housing without the internal components.

FIG. 5 shows the cathode end opening 204 with the body 250 of the housing 202 without the manifold 244, the annular bracket 207, the elongate internal fin array cover 236, or the cathode internal fin array cover 232. As such, the internal fin array 230 is illustrated to show the finned fluid passageway 240 defined by the internal fin array 230.

Figure 6A:
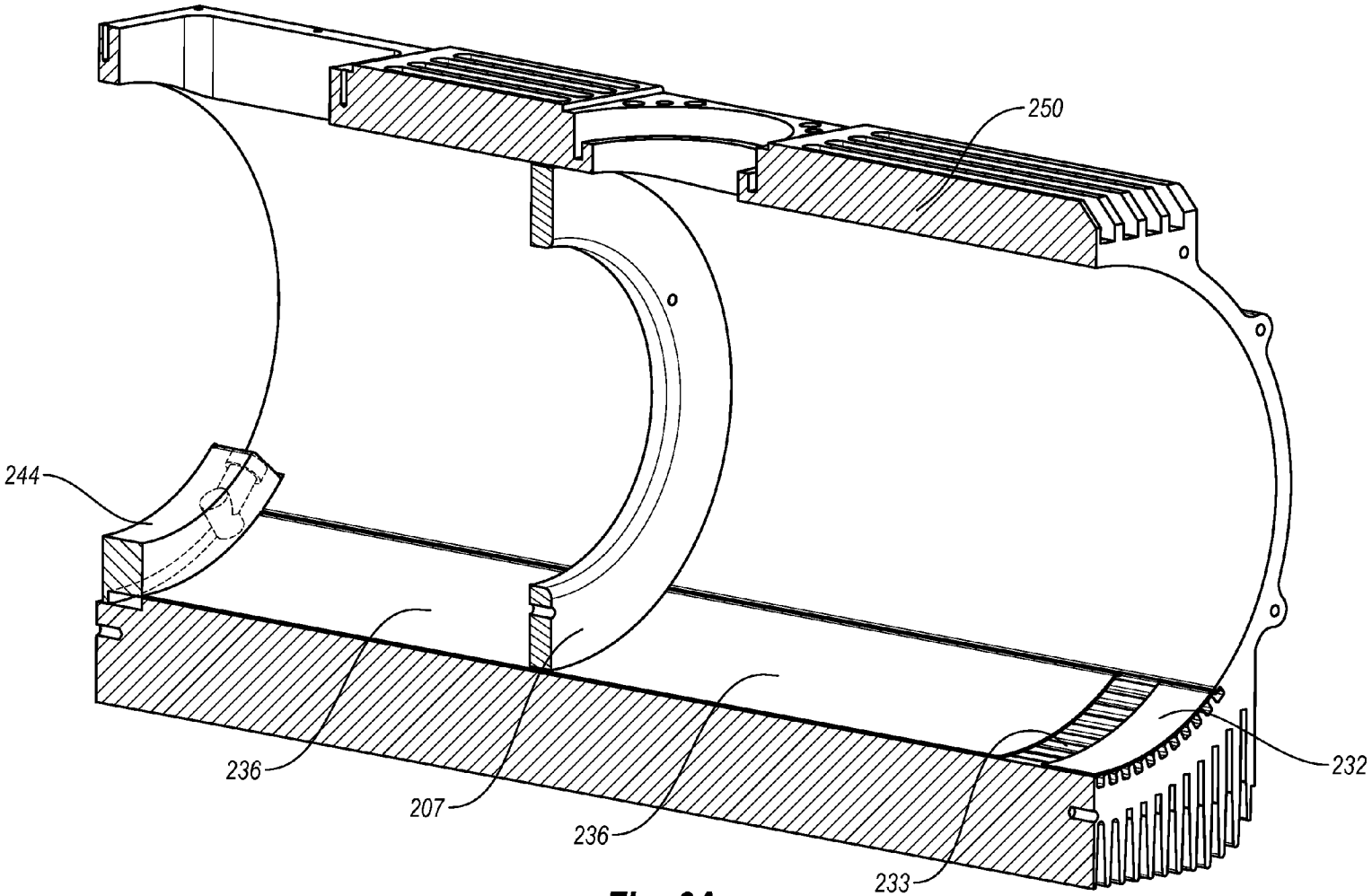
FIG. 6A illustrates a longitudinal cross-section of an x-ray housing having internal fins covered with the internal components.
Figure 6B:
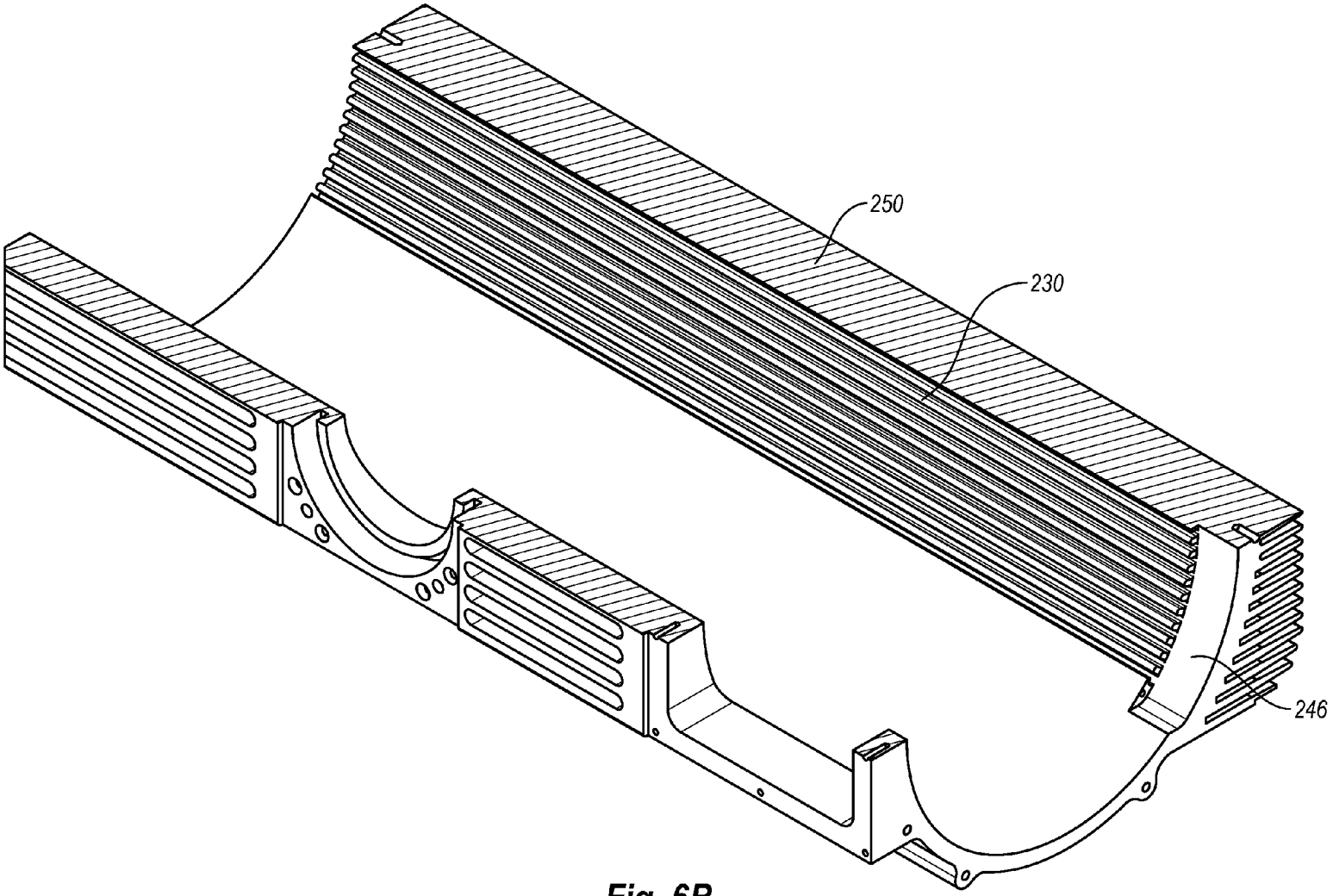
FIG. 6B illustrates the x-ray housing of FIG. 6A with the internal components removed to show the internal fins.

FIG. 6A shows a longitudinal cross-sectional profile of the body 250 of the housing 202 that shows the manifold 244, the annular bracket 207, the elongate internal fin array cover 236, the cathode internal fin array cover 232, and the gap 233 between the elongate internal fin array cover 236 and the cathode internal fin array cover 232. FIG. 6B shows a longitudinal cross-sectional profile of the housing 202 that shows the body 250 without the manifold 244, the annular bracket 207, the elongate internal fin array cover 236, and the cathode internal fin array cover 232 in order to show the internal fin array 230 extending to the anode manifold recess 246.

Figure 7:
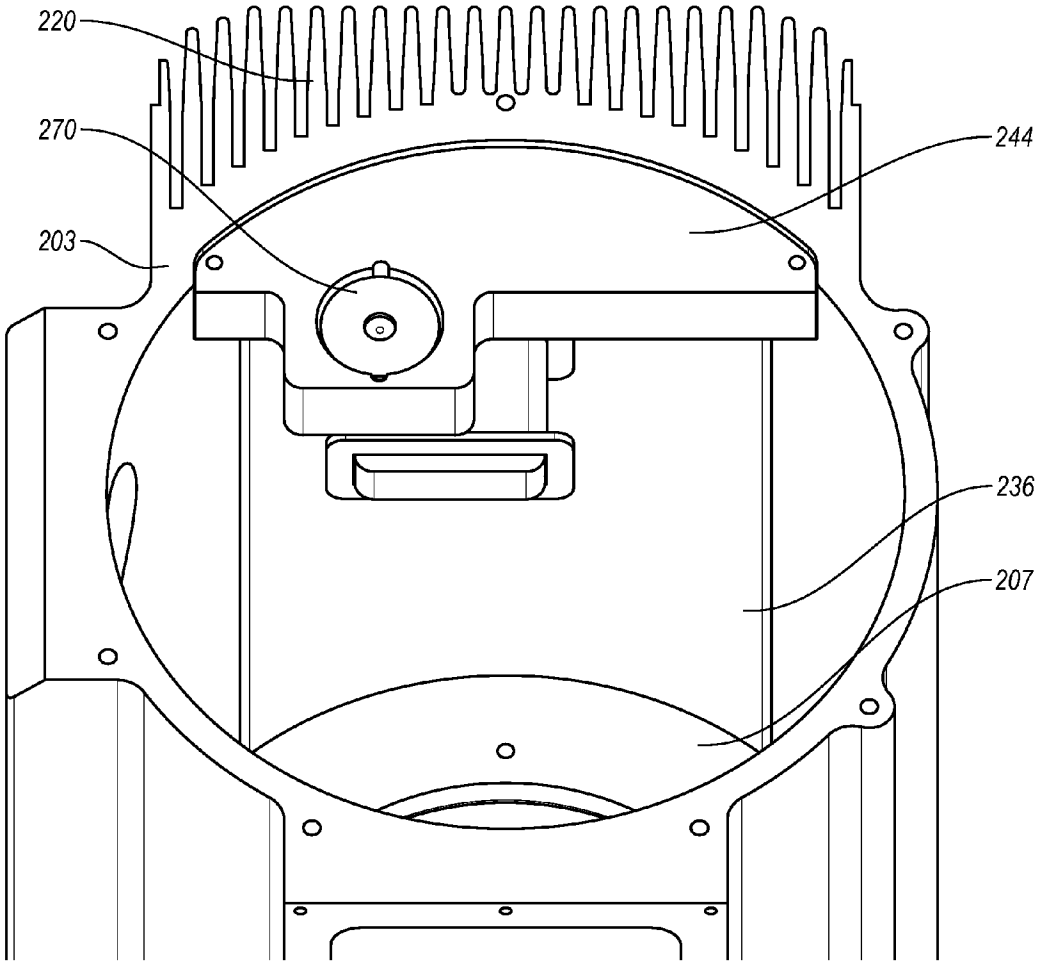
FIG. 7 illustrates an embodiment of a manifold pump fluidly coupled with the internal fluid pathway.

FIG. 7 illustrates an x-ray housing 202 that shows the anode end 203 with the anode manifold recess 246 receiving the manifold 244 and the elongate internal fin array cover 236 covering the internal fin array 230 and the finned fluid passageway 240. Here, the manifold includes a manifold pump 270. While not shown, the manifold pump 270 pumps fluid coolant through the manifold 244 and into the finned fluid passageway 240. While the manifold 244 is shown to include the manifold pump 270 integrated therewith, a separate pump may be fluidly coupled with the manifold 244 in another embodiment. Tubing can connect the pump with the manifold inlet 248. The manifold pump 270 can pump coolant fluid so that it flows through the finned fluid passageway 240 out of the gap 233 between the cathode internal fin array cover 232 and elongate internal fin array cover 236. As such, the manifold pump 270 pumps the coolant fluid into the finned fluid passageway 240 and out of the gap 233 so as to circulate the coolant fluid from the anode end opening 206 to the cathode end opening 204. However, the opposite fluid flow path can be used by operating the manifold pump 270 in the opposite direction.

Figure 8:
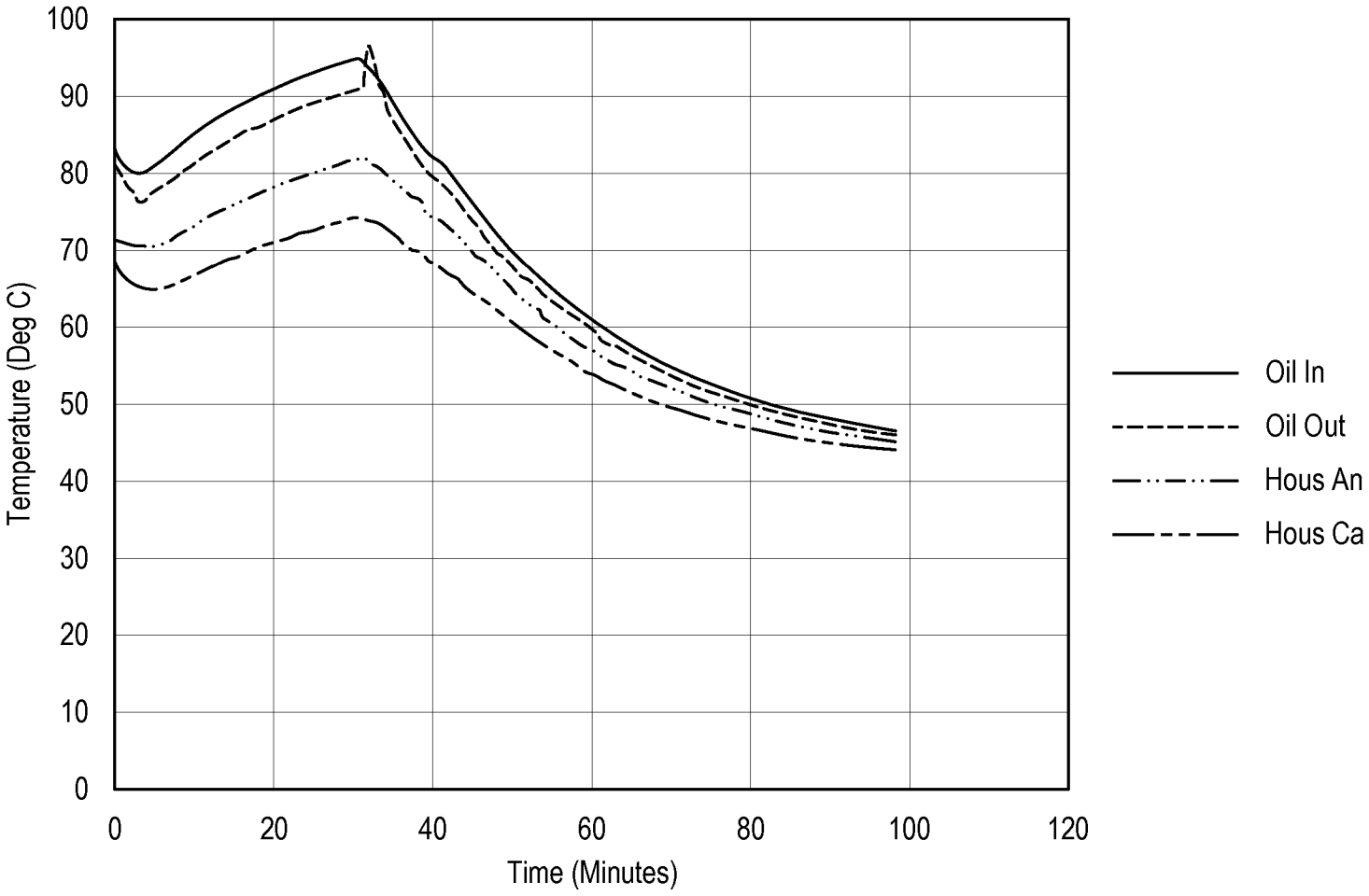
FIG. 8 includes temperature data that shows cooling of the x-ray housing with the internal fins and external fins as an integrated oil and air heat exchanger.

FIG. 8 shows temperature data for the x-ray housing. As such, all of the temperatures for the oil in, oil out, housing anode (Hous An), and housing cathode (Hous Ca) show an initial increase in temperature that is within a suitable range and temperature change rate over the operational time of the x-ray being operational. Once the x-ray is powered off, the temperatures all decrease suitably. Oil in indicates the temperature of the oil (e.g., coolant fluid) before it enters the pump. Oil out indicates the temperature of oil as it exits the cathode end. The housing anode and housing cathode are temperatures on the outside of the housing near the anode or cathode. This shows that heat is being extracted from the oil by the cooling with the internal fin array and external fin array because the oil temperature out is lower than oil temperature in.

Figure 9:
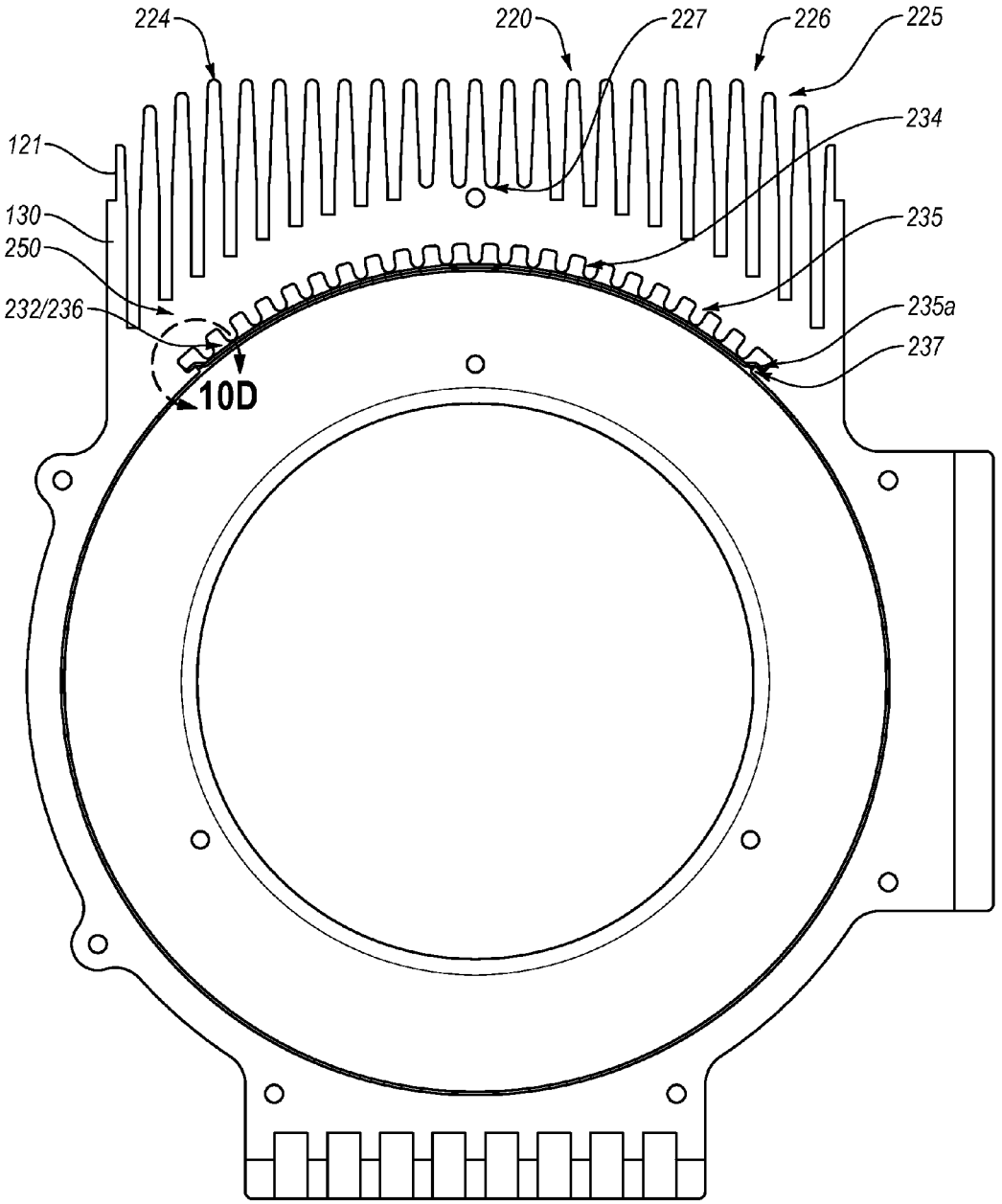
FIG. 9 illustrates an end view of an x-ray housing having internal fins associated with external fins.

FIG. 9 shows an end view of the body 250 of the x-ray housing 202. Here, the external fin array 220 is shown to include a plurality of the external fins 224 separated by a plurality of external fin recesses 226. Starting from the left side, a first set of the external fins 224 have substantially the same height and follow the curvature of the body 250 for about four external fins 224 with the corresponding external fin recesses 226 having substantially the same depth. Then the next set of external fins 224 (e.g., about 17 external fins) form a plateau 225 such that the corresponding external fin recesses 226 have shallower depths to an apex 227 then increasing depths to the left side. The next set of external fins 224 mirror the first set and follow the curvature of the body 250. The plateau 225 allows for the cooling system to set thereon with the air circulating system 260 positioned over the external fin array 220 so that the fan plate 264 positions the fans 262 to circulate air through the external fin array 220. The fan plate 264 can be in contact with the plateau 225. However, the fan plate 264 can be suspended above the plateau 225. The end fins can be configured as risers 130, and are shown to have a shelf 121 dimensioned to receive the fan plate 264.

FIG. 9 also shows that the internal fins 234 are about the same height so that internal fin recesses 235 have about the same depth. The internal fin array 230 is curved to match the curvature of the body 250. As such, the finned fluid passageway 240 has a curved or arc shape.

FIG. 9 also shows that the end fin recess 235*a* have shelves 237, which facilitate coupling of the cathode internal fin array cover 232 and elongate internal fin array cover 236 with the body 250 of the x-ray housing 202. A magnified view of the shelves 237 is shown in FIG. 10E.

The x-ray housing 202 can have various dimensions for the different features. However, preferred dimensions are provided as examples. The body 250 can have a length of about 17.25 inches, which can also be the length of the external fin array 220 and the external fins 224 and the external fin recesses 226. The external fin array 220 can have a width of about 5.6 to about 6 inches with the external fins 224 having a width of about 0.1 inches and the external fin recesses can have a width of about 0.1 inches. The external fins 224 and the external fin recesses 226 can have a taper of about 4.6 degrees. The middle external fins 224 can have a height of about 0.75 inches to 1 inch, where outer external fins can have a height of about 0.87 inches to about 1 inch. The distance from riser 130 to riser 130 can be about 5.6 inches. The thickness of the riser 130 can be about 0.25 inches. The face with the ports can have a width of about 3.5 inches. The distance from one end cap mounting recess to another on the other side can be about 6.28 inches. The distance from one end cap mounting recess to another on the same side can be about 3.5 inches. The distance from the body 250 at the base of the external fin recesses 226 to the other side of the body 250 (e.g., to base of recesses of the secondary external fin arrays 222) can be about 7 inches, with the secondary fins and/or secondary fin recesses being from about 0.15 to about 0.25 inches. The width of the secondary fin array can be about 3.5 inches. The radius from a central longitudinal axis of the lumen 208 to the base of the external fin recesses 226 can be about 3.75-4 inches. The radius from a central longitudinal axis of the lumen 208 to the tip of the internal fins 234 can be about 2.75-3.25 inches (e.g., 3.18 inches). The radius from the central longitudinal axis of the lumen 208 to lumen wall can be about 3.15 inches. The radius from the central longitudinal axis to covers can be about 2.75 inches. The length of the fins of the secondary fin array can be about 0.5 inches. The width of the secondary fin array can be about 3 inches. The straight distance or width (not circumferential) from one side of the internal fin array to the other side can be about 4.1 inches to 4.3 inches, which can also be the width of the covers (e.g., cathode end cover and elongate cover) that cover the internal finned fluid passageway 240 as well as the width of the manifold 244. The internal fin array 230 and the internal finned fluid passageway 240 can extend around the body 250 at about 60 degrees to about 120 degrees, or about 70 degrees, or about 80 degrees (e.g., 86 degrees), or about 90 degrees, or about 100 degrees, or about 110 degrees. The angle between the adjacent external fins 224 or external recesses can be about 3.8 to about 4 degrees. The height of the internal fins 234 can be about 0.5 to about 0.15 inches. These dimensions can vary, and are provided as examples. For example, these dimensions can range up to about 33%, 25%, 20%, 15%, 10%, 5%, 2.5%, or 1%.

In one embodiment, the cathode lumen 208*a* can be coated with lead. The lead coating can be from about 0.05 to about 0.5 inches thick. The lead coating may also be on the annular bracket 207 on the cathode lumen 208*a* side. The opening of the annular bracket 207 can be about 4 inches. The annular bracket 207 can be located a distance from the anode end 203 of about 7.5 inches. The annular bracket 207 can have a thickness of about 0.4 inches. The anode manifold recess 246 can have a dimension from the anode end 301 to the internal fin array 230 of about 1 inch. The x-ray housing window aperture can have a width of about 2.25 to about 3.5 inches. The ports 210, 212 can have dimensions of about 2.5 to about 2.75 inches.

Figure 10A:
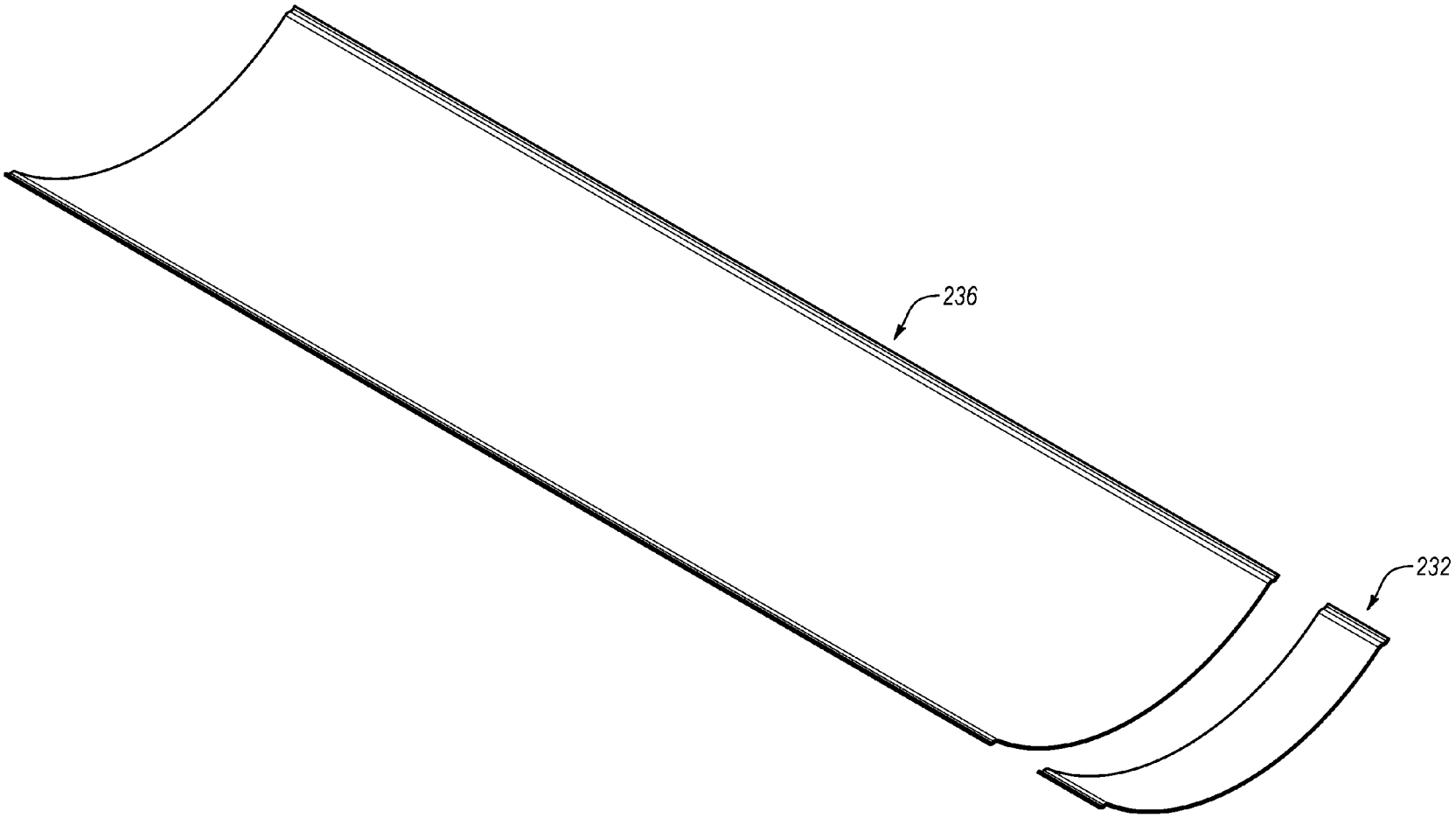
FIGS. 10A-10D illustrate different views of internal fin array covers that form an internal fluid pathway with the body of the x-ray housing.
Figure 10B:
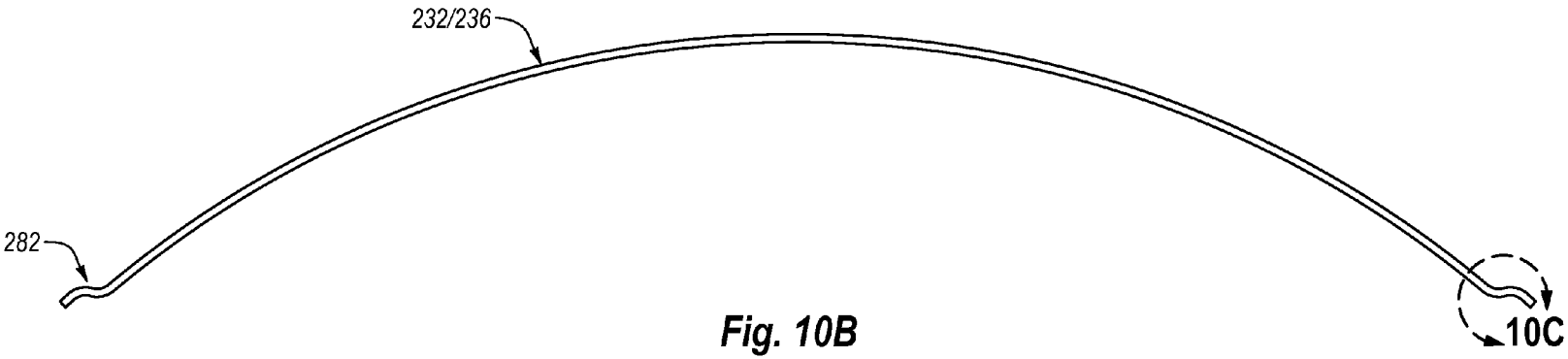
Figure 10D:
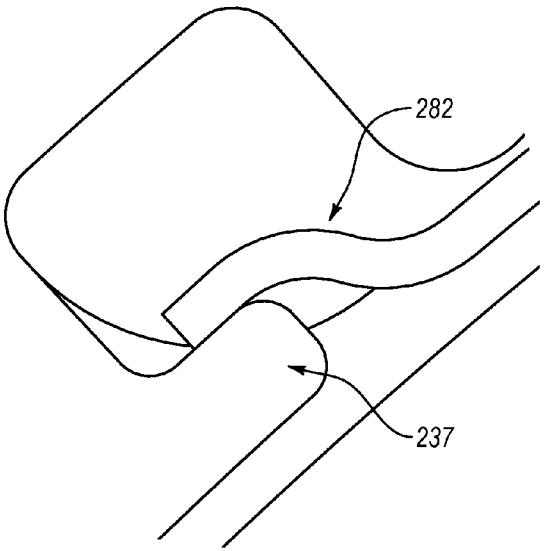
Figure 10C:
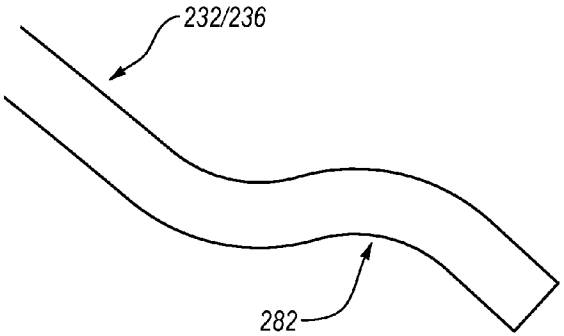

FIG. 10A shows a perspective view of the cathode internal fin array cover 232 and the elongate internal fin array cover 236, which shows the arc cross-sectional shape. The internal surface of the cathode internal fin array cover 232 and the elongate internal fin array cover 236 may or may not be finned. FIG. 10B shows a cross-sectional of the cathode internal fin array cover 232 or the elongate internal fin array cover 236. As shown in FIG. 10C, the ends of the cathode internal fin array cover 232 and/or the elongate internal fin array cover 236 can include a flange 282. As shown in FIG. 10D, the flange 282 can fit on the shelves 237 to hold the cathode internal fin array cover 232 or the elongate internal fin array cover 236 to the body 250 of the x-ray housing, and thereby form the finned fluid passageway 240.

The cathode internal fin array cover 232 can have a length of about 1 inch. The elongate internal fin array cover 236 can have a length of about 14.75 inches. The arc of the covers 232, 236 can have the angle of the internal fin array as described herein, where about 85-86 degrees can be an example. The flange 282 can have a rise of about 0.05 inches and a length of about 0.125 inches. The gap between the covers 232, 236 can be about 1 to 1.25 inches. The shelves 237 can be about 0.06 inches by 0.06 inches. These dimensions can vary, and are provided as examples. For example, these dimensions can range up to about 33%, 25%, 20%, 15%, 10%, 5%, 2.5%, or 1%.

In one embodiment, an x-ray housing can include a tubular unitary body having an external fin array adjacent to an internal fin array through a heat exchanger portion of the unitary body, the internal fin array being on a luminal surface of a housing lumen of the unitary body. In one aspect, the external fin array extends from a first end of the housing to a second end of the housing. In one aspect, the external fin array extends around a portion of a circumference or external surface of the housing. In one aspect, the external fin array covers a finned external surface between the first end and second end of the housing with a plurality of external fins separated by a plurality of external fin recesses. The external surface can include a non-finned region. In one aspect, the external fins and fin recesses extend from the first end to the second end of the housing. In one aspect, the internal fin array extends from the first end of the housing to an arced manifold recess at the second end of the housing. In one aspect, the internal fin array extends around a portion of the circumference of the housing lumen. The internal surface can include a portion without a finned array. In one aspect, the internal fin array is located in a finned recess formed in the luminal surface, and extends between the first end and arced manifold recess with a plurality of internal fins separated by a plurality of internal finned recesses. In one aspect, the internal fins and fin recesses extend from the first end to arced manifold recess of the finned housing. In one aspect, the finned recess extends from the first end to arced manifold recess of the luminal surface of the housing.

In one embodiment, the external fin array includes fins that point along a common lateral axis. In one aspect, the internal fin array includes fins that point inwardly. In one aspect, the internal fin array includes fins that point in toward a central longitudinal axis. In one aspect, the external fin array includes fins that are parallel. In one aspect, the external fin array includes a plurality of fins that form a plateau. In one aspect, the internal fin array includes fins having a substantially same height. In one aspect, the external fin array includes longitudinally aligned fins that are parallel. In one aspect, end fins of the external fin array have apertures extending therethrough in a lateral direction. In one aspect, a platform of a cooling system is mounted to the apertures of the end fins.

In one embodiment, the tubular unitary includes a cylindrical core with the external fin array protruding therefrom. In one aspect, the tubular unitary includes a cylindrical core with the internal fin array formed therein in an internal finned recess.

In one embodiment, the housing includes a finned side having the external fin array and a ported side devoid of fins, the ported side having one or more ports that extend through the unitary body into the housing lumen.

In one embodiment, the housing includes a cooling system coupled with the unitary body of the housing. In one aspect, the cooling system includes one or more fans oriented to cause air to flow over the external fin array. In one aspect, the cooling system includes a platform having the one or more fans mounted to the unitary body, the platform being coupled to end fins of the external fin array.

In one embodiment, the housing includes an internal fin array cover coupled to the unitary body over the internal fin array so as to form a finned conduit with the internal fin array. In one aspect, the internal fin array is located in a finned recess, and the internal fin array cover forms a continuous surface with the luminal surface of the housing. In one aspect, the housing includes at least two internal fin array covers coupled to the unitary body over the internal fin array so as to form a finned conduit with the internal fin array with a gap between the at least two internal fin array covers. In one aspect, the gap provides an opening into the finned conduit. In one aspect, the internal fin array cover has a concave surface that is smooth. In one aspect, the internal fin array cover has a convex surface that is smooth. In one aspect, the internal fin array cover has a concave surface that is finned. In one aspect, an end of the internal fin array cover is at an edge of the arced manifold recess. In one aspect, the internal fin array cover has a length shorter than a longitudinal length of the unitary body so that the finned passageway opens to the housing lumen.

In one embodiment, the housing can include end fin recesses of the internal fin array having shelves. Also, ends of the internal fin array cover can have flanges. The flanges can be received against the shelves to couple the internal fin array cover to the unitary body.

In one embodiment, the x-ray housing can include a manifold recess at an end of the luminal surface of the housing, where the internal fin array extends from the manifold recess. The housing can also include a manifold located in the manifold recess, where the manifold has one or more manifold ports that fluidly couple the housing lumen with a finned passageway formed by the internal fin array and internal fin array cover. In one aspect, the manifold is flush when an end of the housing.

In one embodiment, the housing includes a coolant fluid pump fluidly coupled with the one or more manifold ports of the manifold. In one aspect, the coolant fluid pump is integrated with the manifold. In one aspect, a fluid tube fluidly couples the coolant fluid pump with the one or more manifold ports of the manifold.

In one embodiment, the housing includes a mounting bracket mounted to the luminal surface of the housing lumen.

In one embodiment, the housing includes an x-ray window aperture. In one aspect, the x-ray window aperture is opposite of the external fin array.

In one embodiment, an x-ray device can include an x-ray housing of one of the embodiments or configurations described herein, and include an x-ray tube located in the housing.

In one embodiment, a method of cooling an x-ray device can be performed with the housing having the internal fin array and external fin array. The internal fin array and external fin array can be considered to be an integrated oil to air heat exchanger as the coolant fluid can be oil that is located adjacent to the internal fin array and the air is located adjacent to the external fin array. The cooling method can include pumping coolant fluid (e.g., oil) across the internal fin array such that heat is transferred from the coolant fluid into the body of the unitary housing by the internal fin array. The cooling method can also include blowing air across the external fin array such that heat is transferred from the body of the housing into the blown air by the external fin array.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc.

As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. An x-ray housing comprising:

a tubular unitary body having an elongate external fin array and internal lumen, the external fin array extending between a first end of the tubular unitary body and a second end of the tubular unitary body;

an elongate internal fluid passageway recess formed into a lumen wall of the tubular unitary body across from the external fin array through a heat exchanger portion of the tubular unitary body, the external fin array and internal fluid passageway recess both circumferentially extending partially around the tubular unitary body such that corresponding side edges of the external fin array and the internal fluid passageway recess are radially proximal; and a manifold recess in the internal lumen at the second end of the tubular unitary body, the manifold recess formed into the lumen wall through the heat exchanger portion of the tubular unitary body, the manifold recess circumferentially extending around the tubular body between the corresponding sides of the external fin array, and wherein the internal fluid passageway extends from the first end of the tubular unitary body to the manifold recess.

2. The x-ray housing of claim 1, comprising one or more recess covers mounted to the lumen wall of the tubular unitary body over the internal fluid passageway recess so as to form an internal fluid passageway, the one or more recess covers extending from the manifold recess towards the first end of the tubular unitary body so that there is an opening from the internal fluid passageway to the internal lumen proximal to the first end of the tubular unitary body, the internal fluid passageway being configured to allow fluid to flow between the manifold recess and the opening proximal to the first end of the tubular unitary body.

3. The x-ray housing of claim 2, comprising an internal fin array formed by the tubular unitary body so that the internal fluid passageway is an internal finned fluid passageway.

4. The x-ray housing of claim 3, wherein:

the internal fin array extends from the first end of the tubular unitary body to the manifold recess in the lumen wall at the second end of the tubular unitary body.

5. The x-ray housing of claim 3, comprising a manifold in the manifold recess, the manifold having at least one manifold port that fluidly couples the lumen to the internal finned fluid passageway.

6. The x-ray housing of claim 5, comprising a pump fluidly coupled with the manifold port so as to pump fluid coolant through the internal finned fluid passageway.

7. The x-ray housing of claim 6, wherein the pump is integrated with the manifold.

8. The x-ray housing of claim 3, the one or more covers comprising an elongate cover adjacent to the manifold and extending toward the opening proximal to the first end.

9. The x-ray housing of claim 8, comprising a second cover at the first end of the tubular unitary body with a gap between the elongate cover and second cover, wherein the gap forms the opening proximal to the first end so as to expose the internal fin array to the lumen.

10. The x-ray housing of claim 9, comprising a mounting bracket mounted in the lumen to the lumen wall between the first end and second end.

11. The x-ray housing of claim 3, comprising an x-ray housing window aperture formed into the tubular unitary body in a region without the internal fin array that is across from the internal fin array and external fin array.

12. The x-ray housing of claim 3, wherein the one or more recess covers include edge-flanges that are received into end fin recesses of the internal finned fluid passageway and mounted to shelves that define the end fin recesses.

13. The x-ray housing of claim 3, wherein:

the external fin array includes a plurality of longitudinal parallel external fins, wherein the external fins are laterally parallel; and the internal fin array includes a plurality of longitudinal parallel internal fins, wherein the internal fins are laterally radial.

14. The x-ray housing of claim 13, the plurality of longitudinal parallel fins are directed toward a fan cooling system coupled with the housing with one or more fans oriented to cause air to flow over the longitudinal parallel fins.

15. The x-ray housing of claim 1, comprising a fan cooling system coupled with the housing with one or more fans oriented to cause air to flow over the external fin array.

16. A method of cooling an x-ray device, the method comprising: providing the x-ray housing of claim 1 having an x-ray tube in the lumen with fluid coolant between portions of the x-ray tube and lumen wall of the x-ray housing; passing the fluid coolant from the lumen through the internal fin array such that heat is transferred from the fluid coolant into the heat exchanger portion of the tubular unitary body; and blowing air across the external fin array such that heat is transferred from the heat exchanger portion of the tubular unitary body into the blown air by the external fin array.

17. An x-ray housing comprising:

a tubular unitary body having an elongate external fin array and internal lumen, the external fin array extending between a first end of the tubular unitary body and a second end of the tubular unitary body;

an elongate internal fin array formed into a lumen wall of the tubular unitary body across from the external fin array through a heat exchanger portion of the tubular unitary body, the external fin array and internal fin array both circumferentially extending partially around the tubular unitary body such that corresponding side edges of the external fin array and the internal fin array are radially proximal; and a manifold recess in the internal lumen at the second end of the tubular unitary body, the manifold recess formed into the lumen wall through the heat exchanger portion of the tubular unitary body, the manifold recess circumferentially extending around the tubular body between the corresponding sides of the internal fin array, and wherein the internal fin array extends from the first end of the tubular unitary body to the manifold recess.

18. The x-ray housing of claim 17, comprising one or more covers mounted to the lumen wall of the tubular unitary body over the internal fin array so as to form an internal finned fluid passageway defined by the internal fin array and one or more recess covers, the one or more recess covers extending from the manifold recess towards the first end of the tubular unitary body so that there is an opening from the internal finned fluid passageway to the internal lumen proximal to the first end of the tubular unitary body, the internal finned fluid passageway configured to allow fluid to flow between the manifold recess and the opening proximal to the first end of the tubular unitary body.

19. The x-ray housing of claim 18, comprising a manifold in the manifold recess, the manifold having at least one manifold port that fluidly couples the lumen to the internal finned fluid passageway.

20. The x-ray housing of claim 19, comprising a pump fluidly coupled with the manifold port so as to pump fluid coolant through the internal finned fluid passageway.

21. A method of cooling an x-ray device, the method comprising:

providing the x-ray housing of claim 17 having an x-ray tube in the lumen with fluid coolant between portions of the x-ray tube and lumen wall of the x-ray housing; passing the fluid coolant from the lumen through the internal fin array such that heat is transferred from the fluid coolant into the heat exchanger portion of the tubular unitary body; and blowing air across the external fin array such that heat is transferred from the heat exchanger portion of the tubular unitary body into the blown air by the external fin array.

* * * * *